US007136326B1

(12) United States Patent
Smith

(10) Patent No.: US 7,136,326 B1
(45) Date of Patent: Nov. 14, 2006

(54) WATCH

(76) Inventor: Kelly S. Smith, 31 Autumn Ln, Matawan, NJ (US) 07747

( * ) Notice: Subject to any disclaimer, the term of this patent is extended or adjusted under 35 U.S.C. 154(b) by 81 days.

(21) Appl. No.: 10/782,099

(22) Filed: Feb. 19, 2004

(51) Int. Cl.
*G04B 19/00* (2006.01)

(52) U.S. Cl. ..... 368/223; 368/282

(58) Field of Classification Search ..... 368/10, 368/84, 176, 223, 242, 276, 281, 282
See application file for complete search history.

(56) References Cited

U.S. PATENT DOCUMENTS 3,117,412 A * 1/1964 Malone ..... 368/80
4,195,220 A * 3/1980 Bristol et al. ..... 377/13
4,340,808 A * 7/1982 Donohoo ..... 377/13
4,478,521 A * 10/1984 Evans et al. ..... 368/8
5,023,850 A * 6/1991 Metts et al. ..... 368/28
5,696,740 A 12/1997 Inabinet
5,708,628 A 1/1998 Chen
6,499,423 B1 12/2002 Mills
6,556,222 B1 * 4/2003 Narayanaswami ..... 715/786
6,809,993 B1 * 10/2004 Muller et al. ..... 368/242
2005/0007888 A1 * 1/2005 Jolidon ..... 368/110

FOREIGN PATENT DOCUMENTS

JP 54058066 A * 5/1979

* cited by examiner

*Primary Examiner*—Kamand Cuneo
*Assistant Examiner*—Jeanne-Marguerite Goodwin

(57) ABSTRACT

A watch for displaying time in hours and hundredths of an hour. The watch includes a housing assembly being designed for being worn by the user. A timing assembly is positioned in the housing assembly and operationally coupled to a power supply. The power supply supplies power the timing assembly. The timing assembly is designed for providing a pulse every second when the power supply supplies power to the timing assembly. A processing assembly is positioned in the housing assembly. The processing assembly is operationally coupled to the power supply for supplying power to the processing assembly. The processing assembly is operationally coupled to the timing assembly to receive the pulse from the timing assembly and process the pulse into a time to be displayed on a display member operationally coupled to the processing assembly. The processing member displays minutes calculated by the processing assembly in hundredths of an hour.

1 Claim, 2 Drawing Sheets

WATCH

BACKGROUND OF THE INVENTION

1. Field of the Invention

The present invention relates to time conversion devices and more particularly pertains to a new watch for displaying time in hours and hundredths of an hour.

2. Description of the Prior Art

The use of time conversion devices is known in the prior art. U.S. Pat. No. 6,499,423 describes a device for converting one form of time measurement into another form of time measurement such as from civilian to military time or aviation time. Another type of time conversion device is U.S. Pat. No. 5,708,628 having a device for permitting a user to determine the time in any of the times of the world. U.S. Pat. No. 5,696,740 has a timepiece for converting between military time and civilian time.

While these devices fulfill their respective, particular objectives and requirements, the need remains for a device that has certain improved features to display the minutes in the hundredths of an hour.

SUMMARY OF THE INVENTION

The present invention meets the needs presented above by providing a processing assembly that coverts the minutes of the time into hundredths of an hour and displays that time on the display member.

Still yet another object of the present invention is to provide a new watch that also displays the current time along side the time in hours and hundredths of an hour.

To this end, the present invention generally comprises a housing assembly being designed for being worn by the user. A timing assembly is positioned in the housing assembly. The timing assembly is operationally coupled to a power supply whereby the power supply supplies power the timing assembly. The timing assembly is designed for providing a pulse every second when the power supply supplies power to the timing assembly. A processing assembly is positioned in the housing assembly. The processing assembly is operationally coupled to the power supply whereby the power supply supplies power to the processing assembly. The processing assembly is operationally coupled to the timing assembly whereby the processing assembly receives the pulse from the timing assembly and processes the pulse into a time to be displayed on a display member operationally coupled to the processing assembly. The processing member displays minutes calculated by the processing assembly in hundredths of an hour.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
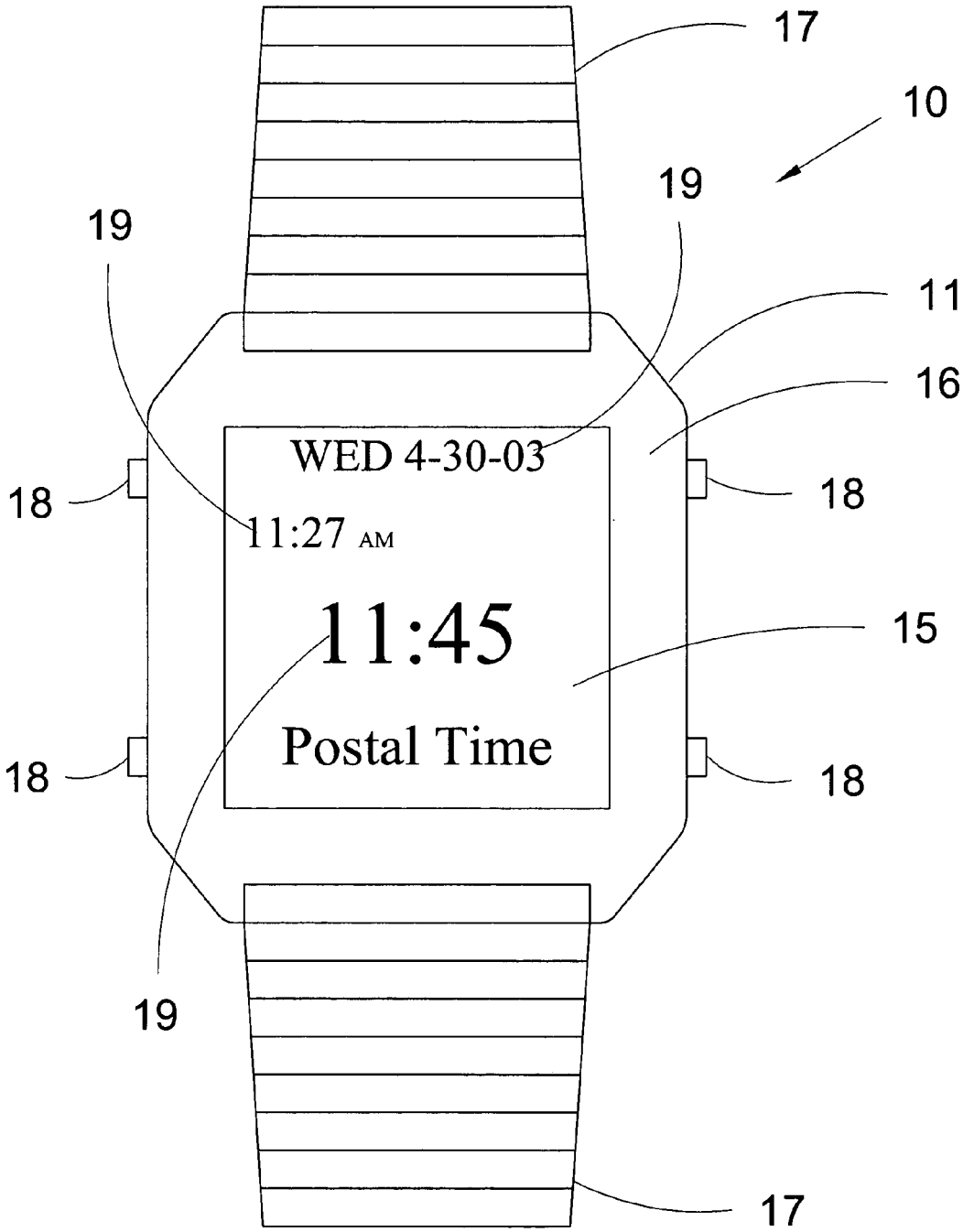
FIG. 1 is a top view of a new watch according to the present invention.
Figure 2:
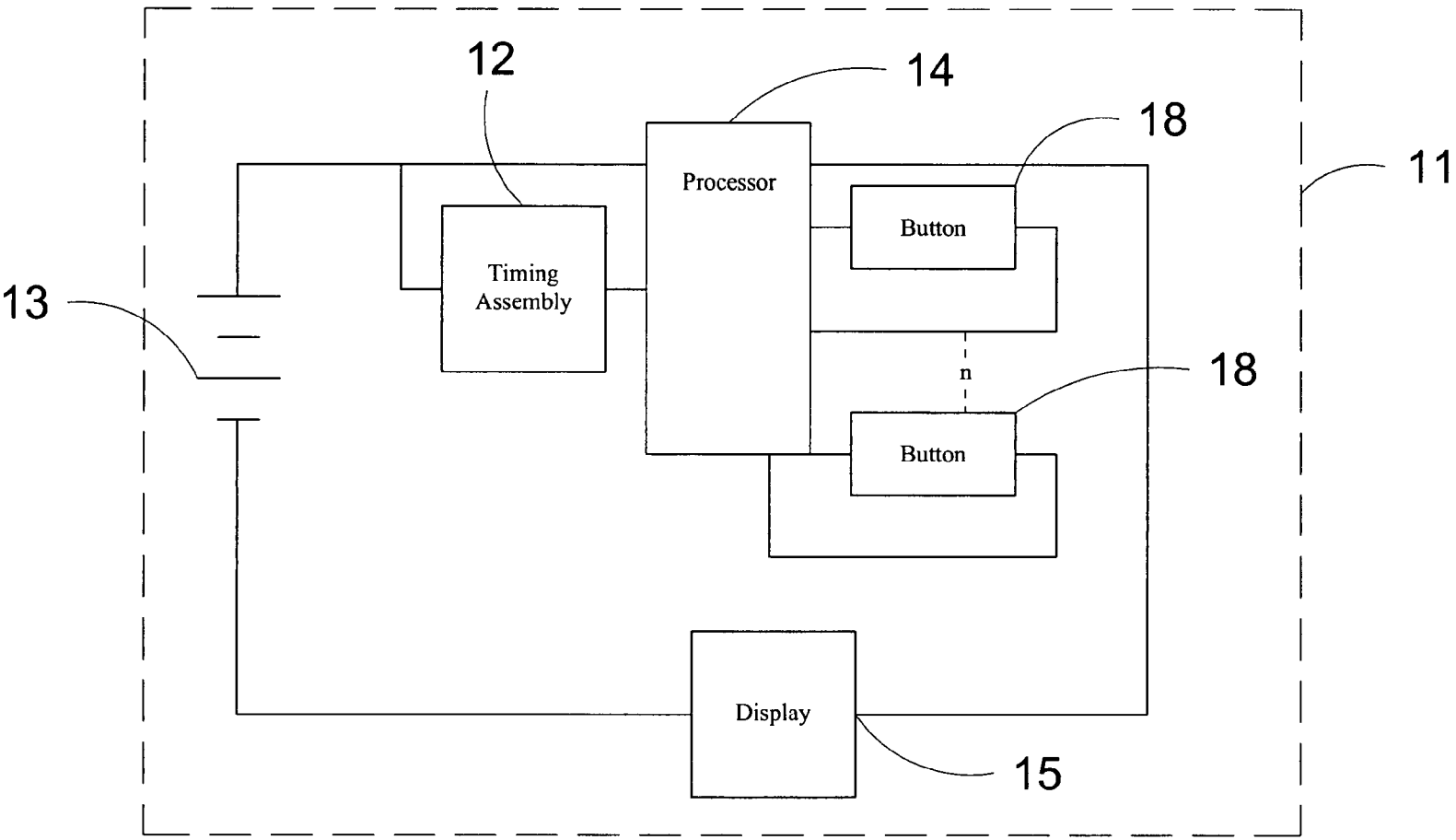
FIG. 2 is a schematic view of the present invention.

With reference now to the drawings, and in particular to FIGS. 1 and 2 thereof, a new watch embodying the principles and concepts of the present invention and generally designated by the reference numeral 10 will be described.

As best illustrated in FIGS. 1 and 2, the watch 10 generally comprises a housing assembly 11 being designed for being worn by the user.

A timing assembly 12 is positioned in the housing assembly 11. The timing assembly 12 is operationally coupled to a power supply 13 whereby the power supply 13 supplies power the timing assembly 12. The timing assembly 12 is designed for providing a pulse every second when the power supply 13 supplies power to the timing assembly 12.

A processing assembly 14 is positioned in the housing assembly 11. The processing assembly 14 is operationally coupled to the power supply 13 whereby the power supply 13 supplies power to the processing assembly 14. The processing assembly 14 is operationally coupled to the timing assembly 12 whereby the processing assembly 14 receives the pulse from the timing assembly 12 and processes the pulse into a time to be displayed on a display member 15 operationally coupled to the processing assembly 14. The processing member displays minutes calculated by the processing assembly 14 in hundredths of an hour. The time may be displayed in civilian time or in military time.

The housing assembly 11 comprises a main member 16. The display member 15 is coupled to the main member 16 whereby the display member 15 is designed for being selectively viewed by the user. The main member 16 is designed for being worn on the user to allow the user to selectively view the display member 15.

The housing assembly 11 comprises a plurality of strap members 17. Each of the strap members 17 is coupled to the main member 16 whereby each of the strap members 17 extends outwardly from the main member 16. One of the strap members 17 is selectively coupled to the other one of the strap members 17 whereby the strap members 17 form a loop. The strap members 17 are selectively positioned around an arm of the user to couple the main member 16 to the user.

A plurality of buttons 18 are operationally coupled to the housing assembly 11. Each of the buttons 18 is operationally coupled to the processing assembly 14. Each of the buttons 18 is for actuating the processing assembly 14 for altering the information displayed on the display member 15 when the buttons 18 are actuated by the user.

The display member 15 comprises a plurality of information display areas 19. One of the information display areas 19 displays the date from the processing assembly 14. One of the information display areas 19 displays the time from the processing assembly 14. One of the information display areas 19 displays the time in hours and hundredths of an hour.

In use, the user positions the main portion of the housing assembly 11 on their arm and positions the strap members 17 around the wrist and couples the strap members 17 together to secure the main portion to the wrist of the user. The buttons 18 are then used to actuate the processing member to change the time and date that are displayed on the display member 15. The user then looks at the display member 15 to find out the time by hour and hundredths of an hour, hours and minutes and the date.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A watch for displaying a time to be read by a user, the watch comprising:

a housing assembly having a size making capable of being worn by the user on an arm of the user;

a timing assembly being positioned in said housing assembly, said timing assembly being operationally coupled to a power supply such that said power supply supplies power said timing assembly, said timing assembly being adapted for providing a pulse every second when said power supply supplies power to said timing assembly;

a processing assembly being positioned in said housing assembly, said processing assembly being operationally coupled to said power supply such that said power supply supplies power to said processing assembly, said processing assembly being operationally coupled to said timing assembly such that said processing assembly receives the pulse from said timing assembly and processes the pulse into a time to be displayed on a display member operationally coupled to said processing assembly;

wherein said display member displays time calculated by said processing assembly, said display member simultaneously displaying time in hours and minutes and in hours and hundredths of an hour;

wherein said minutes are displayed serially in integers from 1 to 59 inclusive and said hundredths of an hour are displayed serially in integers from 1 to 99 inclusive;

said housing assembly comprising a main member, said display member being coupled to said main member such that said display member is adapted for being selectively viewed by the user, said main member being adapted for being worn on the user to allow the user to selectively view said display member;

said housing assembly comprising a plurality of strap members, each of said strap members being coupled to said main member such that each of said strap members extends outwardly from said main member, one of said strap members being selectively coupled to the other one of said strap members such that said strap members form a loop, said strap members being selectively positioned around an arm of the user to couple said main member to the user;

a plurality of buttons being operationally coupled to said housing assembly, each of said buttons being operationally coupled to said processing assembly, each of said buttons being for actuating said processing assembly for altering the information displayed on said display member when said buttons are actuated by the user; and said display member comprising a plurality of information display areas, one of said information display areas displaying the date from said processing assembly, one of said information display areas displaying the time from said processing assembly, one of said information display areas displaying the time in hours and hundredths of an hour.

* * * * *